United States Patent [19]

Kirjavainen

[11] 4,008,123

[45] Feb. 15, 1977

[54] BEAM-DEFLECTION COMPENSATING STRUCTURE FOR HEADBOXES

[75] Inventor: Alvi Kirjavainen, Jyvaskyla, Finland

[73] Assignee: Valet Oy, Helsinki, Finland

[22] Filed: July 3, 1975

[21] Appl. No.: 592;985

[30] Foreign Application Priority Data

July 8, 1974 Finland ..... 2096/74

[52] U.S. Cl. ..... 162/336; 52/1; 52/291; 162/347

[51] Int. Cl.[2] ..... D21F 1/02

[58] Field of Search ..... 162/336, 272, 347; 52/1, 291; 29/116 AD

[56] References Cited

UNITED STATES PATENTS

| | | | |
|---|---|---|---|
| 3,014,527 | 12/1961 | Beachler | 162/336 |
| 3,273,492 | 9/1966 | Justus | 29/116 AD |
| 3,749,054 | 7/1973 | Brezinski | 162/336 X |
| 3,769,154 | 10/1973 | Wolf | 162/336 X |

*Primary Examiner*—Robert L. Lindsay, Jr.
*Assistant Examiner*—Richard V. Fisher
*Attorney, Agent, or Firm*—Steinberg and Blake

[57] ABSTRACT

An apparatus, such as the headbox of a paper machine, having the capability of compensating for the tendency of a beam to become deflected due to loads, temperature-differential phenomena and the like. A beam is supported at a pair of locations situated inwardly of the ends of the beam but spaced from the center thereof in such a way that due to loads, temperature-differentials, and the like the beam has a tendency to become deflected from a straight condition to a curved condition extending along a curve which passes through the above locations to the ends of the beam. A force structure cooperates with the beam at the region of the ends thereof for opposing the tendency of the beam to assume the above deflected condition so that through this force structure it becomes possible to prevent undesirable beam deflection.

6 Claims, 4 Drawing Figures

VENT
COMP. AIR

BEAM-DEFLECTION COMPENSATING STRUCTURE FOR HEADBOXES

BACKGROUND OF THE INVENTION

The present invention relates to structure capable of compensating for the tendency of a beam to become deflected as a result of loads which act on the beam and as a result of temperature differentials existing in the beam.

For example, in the headbox of a paper machine, or in an equivalent construction, there is at the front wall of the headbox an elongated beam supported at no less than two points or locations, most appropriately at the so-called Besselian points or in the region thereof, so as to be carried in this way by the frame beam or structure of the headbox.

It is well known that the front wall beam of a headbox of a paper machine forms the component thereof which carries the upper lip structure defining the upper edge of the slice of the headbox. As a result deformation of such a front wall beam and deflection thereof will influence the geometry of the lip slice and therefore the transverse profile or cross section of the stream of pulp stock which flows through the slice onto the wire.

In accordance with known practice in the prior art, in order to attempt to reduce deflection and deformation of such a front wall beam, such a beam is provided with an exceedingly steady structure while at the same time it is supported at the so-called Besselian points according to which, as is well known, the deflection caused by the weight of the beam itself is maintained at a minimum. However, deflection and deformation of such a front wall beam are caused not only by the weight of the beam itself but also by the pressure load imposed by the stock suspension flowing in the headbox as well as by temperature differentials which necessarily exist between the exterior and the interior of the beam. This temperature differential is highest when the paper machine is being started. At such a time the outer surface of the front wall beam of the headbox has the same temperature as the room temperature prevailing in the paper machine gallery, this temperature being on the order of approximately 20° C. At the same time, however, the inner surface of the beam has a temperature which is the same as that of the pulp stock in the headbox, this latter temperature being on the order of 50° C. Thus, there is a temperature differential on the order of 20°–30° C. This temperature differential will cause a considerable deflection of the front wall beam, and this latter deflection will remain for an interval of from 15–30 minutes up to a few hours after the paper machine has started operating, until a stable condition is reached with respect to the temperature-differential and deflection. The pressure load from the stock suspension, on the other hand, remains substantially constant and starts to exert its influence on the beam immediately after the machine has been started.

Because of the above conditions even though the beam is made of a sturdy construction and even though it is supported in the best possible way with respect to minimizing deflection into the weight of the beam, nevertheless particularly during the starting-up interval there is undesirable deflection of the beam creating an undesirable cross section for the slice of the headbox.

SUMMARY OF THE INVENTION

It is accordingly a primary object of the present invention to provide a construction which will avoid the above drawbacks.

In particular, it is an object of the present invention to provide a construction according to which a beam such as the front wall beam of a headbox will have its tendency to become deflected under load or as a result of temperature-differentials compensated particularly during the unstable starting-up conditions.

Thus, it is a particular object of the present invention to minimize the extent of deflection of the front wall beam of an apparatus such as a headbox.

In particular, it is an object of the present invention to provide for such a beam a structure which will respond automatically to a tendency of the beam to become deflected so as to oppose this tendency in a manner which will enable the beam to remain substantially straight under substantially all operating conditions, with the advantage not only of avoiding undesired beam deflection but also of being able to give the beam a lighter construction than would otherwise be possible.

According to the invention an apparatus such as a headbox of a paper machine, particularly the front wall of the headbox, includes an elongated beam supported by a support means at a pair of locations which are spaced inwardly from the ends of the beam but also spaced from the center thereof in such a way that the beam tends to become deflected due to loads, temperature-differentials, and the like to assume a curved condition where the beam extends along a curve passing through the above locations and beyond the latter to the ends of the beam. According to the invention a force means is inoperative engagement with the beam at the region of the ends thereof for opposing the tendency of the beam to assume the above curved condition, so as to compensate for the tendency of the beam to become deflected under the above conditions.

Thus, in accordance with the invention for the purpose of compensating the deflection of the front wall beam of a headbox, as a result of the load imposed on the front wall beam or because of the temperature difference between the inner surface and outer surface of the beam, a controllable force means is provided to act on the end regions of the front wall beam of the headbox.

BRIEF DESCRIPTION OF DRAWINGS

The invention is illustrated by way of example in the accompanying drawings which form part of this application and in which:

FIG. 2 is a schematic front view of the structure of FIG. 1 as seen from the left of FIG. 1;

FIG. 3*a* is a diagrammatic representation of verticle deflection of the front wall beam with FIG. 3*a* also indicating the force provided by the present invention to oppose the tendency of the beam to become deflected due to temperature differentials and the like; and FIG. 3*b* is a diagrammatic representation similar to that of FIG. 3*a* of the horizontal beam deflection and the forces tending to oppose such deflection, with FIG. 3*b* also showing schematically part of one suitable structure for automatically opposing the tendency of the beam to become deflected.

DESCRIPTION OF PREFERRED EMBODIMENTS

Figure 1:
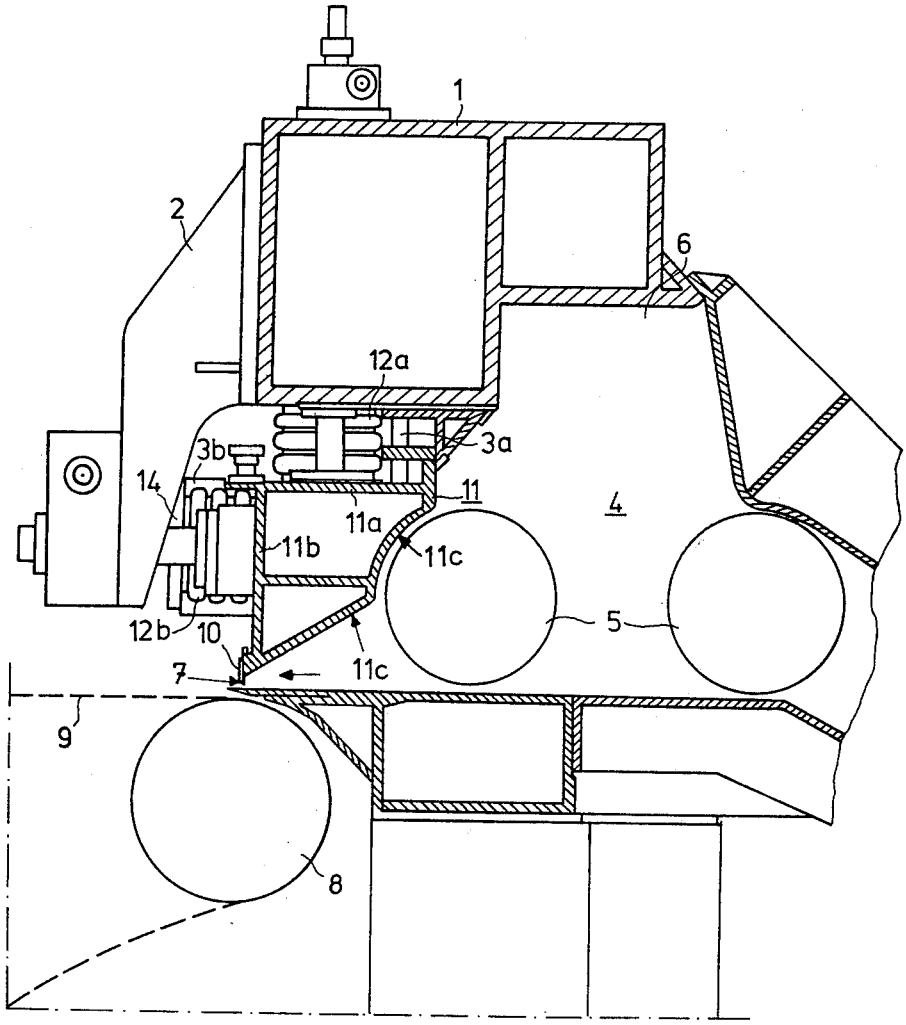
FIG. 1 is a fragmentary partly schematic transverse sectional illustration of a headbox provided with the structure of the invention, the section of FIG. 1 being taken along line I—I of FIG. 2 in the direction of the arrows.

Referring now to the drawings, there is schematically illustrated in FIG. 1 a headbox structure which includes a frame means and a front wall beam supported thereby. The frame means includes an upper hollow frame member or beam 1 which extends horizontally across the upper front portion of the headbox. This upper horizontal frame member 1 is carried by a pair of end frame members 13 so as to be supported thereby on additional frame structure of the paper machine. The frame means further includes vertically extending beams 2 fixed to the front of the frame beam 1 and extending downwardly therefrom inwardly of the ends thereof in the manner apparent from FIGS. 1 and 2.

The upper elongated horizontally extending frame member 1 is situated over and spaced from a front wall beam 11 of the headbox situated at the lower part of the front wall thereof, this beam 11 having an outer front wall 11*b* and an upper wall 11*a*, with the beam 11 being hollow as indicated in FIG. 1 and having an inner wall 11*c*. Suitable supporting pins 3*b* or the like extend between and are fixed to the front wall 11*b* of the beam 11 and the frame members 2 so as to contribute to the support of the beam 11 at its front wall 11*b*. In addition, the upper wall 11*a* is suspended by way of pins 3*a* from the upper frame member 1, so that in this way the components 3*a* and 3*b* form connecting means for connecting the beam 11 to the support means formed by the components 1, 2, 13. The beam 11 is shown schematically by the curved lines in FIGS. 3*a* and 3*b*, and the location of the connecting means 3*a* and 3*b* is apparent from FIGS. 3*a* and 3*b*. The locations or points of the supports provided by way of components 3*a* and 3*b* are inwardly of the ends of the front wall beam 11 but spaced from the center thereof, most appropriately at the so-called Besselian points or in the region thereof. As a result of the location of these supporting points, the deflection produced by the weight of the beam 11 and by uniform pressure-induced loads has its minimum in this two-point mode of support, as is well known.

The headbox 4 illustrated is of a design which is in itself known in the prior art. The headbox has in its interior rotary perforated rolls 5 (FIG. 1) for the purpose of homogenizing the stock suspension. In the upper part of the headbox there is an air space 6. The slice of the headbox 4 is defined in part by an upper lip structure 7 which is carried by a lower front edge region of the beam 11. For the purpose of accurate, fine regulation or adjustment of the geometry of the slice, an adjusting plate 10 is fixed to the lower front edge region of the vertical front wall 11*b* of the front wall beam 11, and through suitable adjustment of the plate 10 it is possible to adjust the lip slice 7. From the slice defined in part by the lip 7 the stock flow discharges onto the forming wire 9 of the paper machine, this forming wire 9 passing around the breast roll 8, as shown schematically at the lower left of FIG. 1.

Figures 2, 3A, 3B:
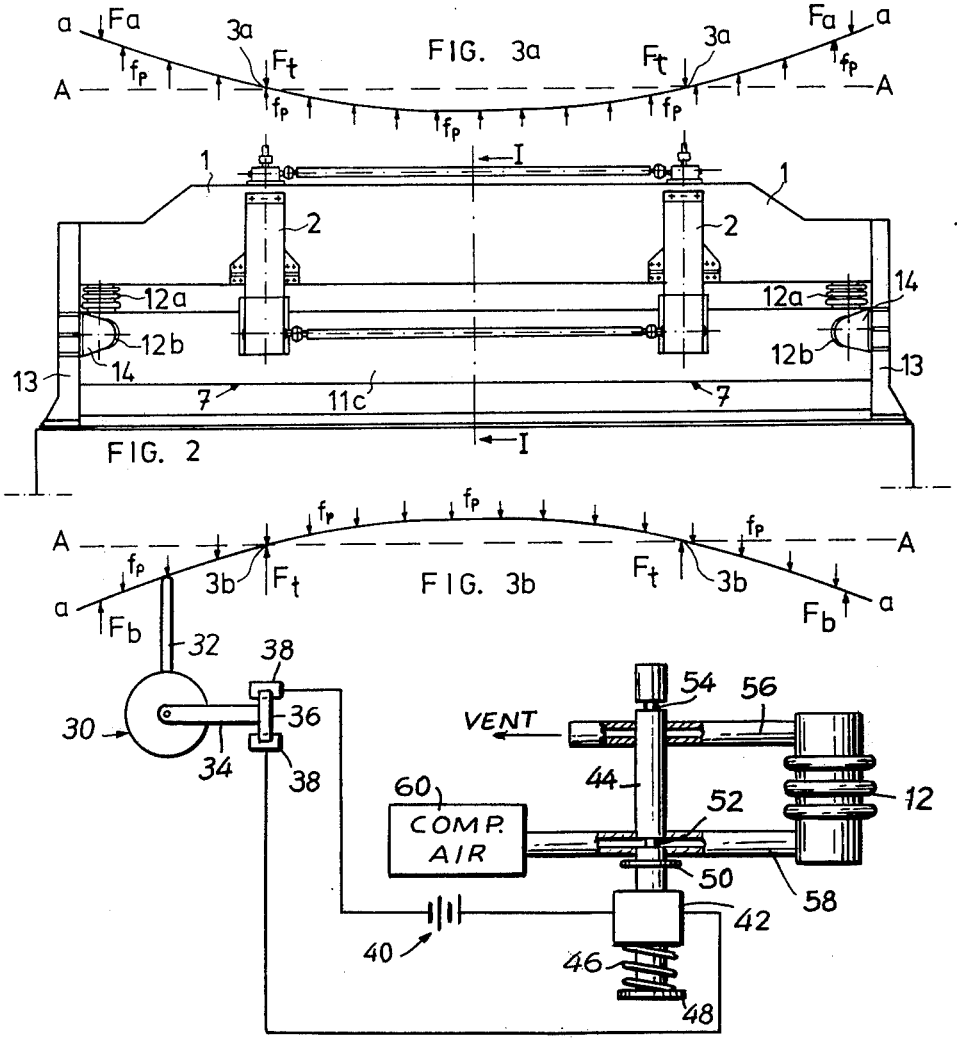

The temperature difference between the outer walls 11*a* and 11*b* of the beam 11 and the inner wall 11*c* thereof, which when the paper machine is started is on the order of 20°–30° C, causes the front wall beam 11 to become deflected in the manner apparent from FIGS. 3*a* and 3*b*. Thus, disregarding all other factors except temperature, since the inner wall 11*c* is at a greater temperature than the outer walls 11*a* and 11*b*, the inner wall 11*c* will tend to expand with respect to the outer walls 11*a* and 11*b* so that the inner wall 11*c* will assume a convex curvature while the outer walls 11*a* and 11*b* will assume a concave curvature, with the result that the opposed ends of the beam 11 curve upwardly in a manner shown in FIG. 3*a* and forwardly in the manner shown in FIG. 3*b*. Thus, as may be seen from FIGS. 3*a* and 3*b*, the beam normally will tend to assume a neutral position indicated by the dotted lines A—A, whereas under stresses resulting from temperature-differentials, loads, and the like, the beam will have a tendency to depart from its straight condition to a curved condition extending along the curves a—a in FIG. 3*a* and 3*b* through the supporting locations 3*a* and 3*b* and beyond the latter to the ends of the beam as illustrated. The arrows $f_b$ represent the load imposed on the front wall beam 11 by the pressure prevailing in the interior of the headbox 4. The pressure loading $f_b$ partly acts in a direction opposite to that of the temperature-differential effect. When, as shown in FIGS. 3*a* and 3*b*, forces $F_a$ of controllable magnitude are provided, with the aid of the structure of the present invention described below, so as to act upon the end regions of the front wall beam 11, it is possible to compensate for the temperature-induced deflection and load-induced deflection of the beam 11. The reaction forces $F_t$ acting on the beam at the points 3*a* and 3*b* will then be reduced because part of the load is transferred so as to be carried instead by the reaction forces $F_a$. By making the forces $F_a$ adjustable it is possible to compensate for the deflection of the beam 11 almost completely so that the beam will be maintained at all times substantially parallel with its neutral line A—A.

Of course, the above considerations with respect to vertical deflection described in connection with FIG. 3*a* are equally applicable to the horizontal deflections shown in FIG. 3*b* where the compensating forces $F_b$ are indicated instead of the forces $F_a$. which act vertically in FIG. 3*a*.

In order to provide the above-mentioned compensating forces $F_a$ and $F_b$, a controllable force means 12 is provided. This force means 12 includes expandable and contractable force units situated between the frame structure 1, 2, 13 and the end regions of the beam 11 at the outer walls 11*a* and 11*b* thereof. In the illustrated example the force means includes, as shown in FIGS. 1 and 2, a pair of upper pneumatic bellows 12*a* situated between the upper frame member 1 and the upper wall 11*a* so that when the bellows 12*a* exert a pressure and tend to expand they will provide the forces $F_a$ shown in FIG. 3*a*. The force means also includes a pair of front bellows 12*b* pressing against the exterior surface of the front wall 11*b* of the hollow beam 11 and situated between this front wall and robust supporting brackets 14 which are fixed to the end frame members 13 and extend inwardly thereof to be situated in front of but spaced from the front wall 11*b* of the beam 11 so that the front bellows 12*b* can press between the supports 14 and the beam 11. Thus, the bellows 12*b* act in a horizontal direction to provide the forces $F_b$ indicated in FIG. 3*b*.

One of the force units 12 is shown schematically in FIG. 3*b*, and it is to be understood that this unit 12 shown in FIG. 3*b* can be anyone of the above bellows 12*a*, 12*b*. As an example of one possible structure for automatically providing the compensating forces, there is schematically shown in FIG. 3*b* a deflection detector 30 of a known construction including an elongated spring-pressed rod 32 which engages the exterior surface of the beam 11 and which in response to deflection thereof will be displaced. This displacement of the spring-pressed rod 32 will in a known way be expanded to provide an appreciable movement of a pointer 34 which is schematically indicated and which is shown as carrying an electrically conductive switch element 36 which is insulated from the pointer 34. This element 36 is adapted to bridge the gap between a pair of switch contacts 38 when the beam 11 has become sufficiently deflected. When engaging both of the contacts 38, the circuit which includes the electrical source of supply 40 will be closed in order to energize a solenoid 42. When the solenoid 42 is energized the rod 44 extending from the armature of the solenoid 42 will be displaced, in opposition to the return spring 46, to the position shown schematically in FIG. 3*b*. The rod 44 forms part of a valve structure extending through a pair of pipes 56 and 58. These pipes communicate with the interior of the bellows 12 and at least at their regions connected to the bellows 12 one or the other of the pipes 56 may be flexible enough to conform to the expansion and contraction of the bellows. The pipe 56 communicates at its left end with the outer atmosphere while the pipe 58 communicates with a tank 60 containing compressed air at a suitable pressure. This tank 60 is provided in its interior with compressed air at a suitable pressure through a known structure including a suitable compressor and a structure which will automatically maintain the air in the tank 60 at a desired pressure. The rod 44 has the reduced portions 52 and 54. Normally when the switch element 36 does not engage both of the contacts 38, the solenoid 42 is unenergized so that the spring 46 expands to act on the end flange 48 and place the collar 50 in engagement with the upper end of the solenoid 42 as viewed in FIG. 3*b*. The result is that at this time the pipe 58 is closed while the reduced portion 54 of rod 44 is situated in the interior of the pipe 56, thus opening the latter so that the interior of the bellows 12 is at atmospheric pressure and so that any fluid under pressure therein will be released to the outer atmosphere. On the other hand, when the switch element 36 bridges the contacts 38, the solenoid 42 becomes energized to displace the reduced portion 54 beyond the pipe 56 so as to close the latter while locating the reduced portion 52 in the interior of the pipe 58. As a result the latter opens to admit air under pressure from the tank 60 into the bellows 12, thus causing the latter to expand and provide a force such as the force $F_a$ or $F_b$.

Thus, with the above structure of the invention any tendency of the front wall beam 11 to become deflected due to temperature-differentials or laods acting thereon can be rapidly compensated, at times which include the period immediately after the paper machine has started to operate, but also including those time during the operation of the paper machine and under any and all service conditions. Furthermore, as a result of the above structure of the invention it is possible to reduce the structural weight of the front wall beam 11 as compared to corresponding beams of the prior art because the beam is maintained in its straight condition with the controls of the present invention.

Of course the invention is not to be narrowly confined to the structure shown in the drawings and described above. Various details may vary within the scope of the following claims. For example, as a force means devices other than pneumatic bellows may be used, and the force means need not necessarily act only in horizontal and vertical directions.

What is claimed is:

1. In a headbox apparatus of a paper machine, an elongated beam and support means supporting said beam at least at a pair of locations situated inwardly of the ends of the beam and spaced from the center thereof so that due to loading, temperature-differential, and the like said beam tends to become deflected from a straight condition to a curved condition where the beam extends along a curve extending between said locations and beyond the latter to the ends of said beam, and force means engaging said beam at the region of said ends thereof for opposing the tendency of said beam to assume said deflected condition, said support means including a frame means and a connecting means connecting said beam to said frame means to be supported by the latter at said locations, said force means being capable of expansion and contraction and being situated between said frame means and beam at the region of the ends of the latter, said beam and frame means forming part of a front wall structure of the headbox, said beam being situated at a lower part of said front wall structure and having a lower edge region carrying structure which forms an upper lip of a slice of the headbox, said frame means including an upper frame member situated over and extending along said beam while being spaced therefrom and said force means including an upper pair of expandable and contractable units situated between said upper frame member and said beam at the region of the ends thereof.

2. The combination of claim 1 and wherein said force means includes expandable and contractable bellows situated between said beam and frame means and fluid-pressure means communicating with said bellows for controlling the flow of fluid under pressure to and from said bellows.

3. The combination of claim 1 and said frame means also including a pair of end frame members carrying said upper frame member and situated adjacent but beyond the ends of said beam, and said force means also including a pair of front expandable and contractable units situated between said end frame members and said beam at a front surface thereof adjacent said ends thereof.

4. The combination of claim 3 and wherein said beam is hollow and has an upper wall engaged by said upper units and a front wall engaged by said front units.

5. The combination of claim 4 and wherein said units are all in the form of expandable and contractable bellows.

6. The combination of claim 5 and wherein a fluid-pressure means is operatively connected with all of said bellows for controlling the flow of fluid under pressure to and from the latter.

* * * * *